US010053348B2

(12) United States Patent
Van den Bremt

(10) Patent No.: US 10,053,348 B2
(45) Date of Patent: Aug. 21, 2018

(54) CORK REMOVER FOR A BOTTLE CONTAINING SPARKLING LIQUID

(75) Inventor: Yvan Van den Bremt, Aalst (BE)

(73) Assignee: Yvan Van den Bremt, Aalst (BE)

( * ) Notice: Subject to any disclaimer, the term of this patent is extended or adjusted under 35 U.S.C. 154(b) by 171 days.

(21) Appl. No.: 14/124,650

(22) PCT Filed: Jun. 7, 2012

(86) PCT No.: PCT/EP2012/060798
§ 371 (c)(1),
(2), (4) Date: Feb. 7, 2014

(87) PCT Pub. No.: WO2012/168362
PCT Pub. Date: Dec. 13, 2012

(65) Prior Publication Data

US 2014/0174259 A1 Jun. 26, 2014

(30) Foreign Application Priority Data

Jun. 7, 2011 (EP) ..... 11168885

(51) Int. Cl.
*B67B 7/06* (2006.01)

(52) U.S. Cl.
CPC ..... *B67B 7/066* (2013.01)

(58) Field of Classification Search
CPC ..... B67B 7/066; B67B 7/0441
USPC ..... 81/3.29, 3.77, 3.55, 3.56
See application file for complete search history.

(56) References Cited

U.S. PATENT DOCUMENTS 4,422,355 A * 12/1983 Burns, Jr. ..... B67B 7/066 81/3.29
4,442,735 A * 4/1984 Chance ..... B67B 7/066 215/272
4,590,821 A 5/1986 Olson
4,680,993 A * 7/1987 Feliz ..... B67B 7/066 81/3.29
4,729,267 A * 3/1988 Giebeler ..... B67B 7/066 81/3.29
4,750,391 A 6/1988 Sweatt
6,016,721 A * 1/2000 Braun ..... B67B 7/066 81/3.29
6,637,295 B2 * 10/2003 Weaver ..... B67B 7/066 81/3.29
7,832,307 B2 * 11/2010 Ferrari ..... B67B 7/0441 81/3.29

FOREIGN PATENT DOCUMENTS

| | | |
|---|---|---|
| DE | 296 20 491 | 1/1997 |
| DE | 10 2008 004 465 | 9/2008 |
| WO | WO 2006/092661 | 9/2006 |
| WO | WO 2008/061547 | 5/2008 |

* cited by examiner

*Primary Examiner* — Hadi Shakeri
(74) *Attorney, Agent, or Firm* — Levy & Grandinetti

(57) ABSTRACT

The present invention relates to a cork remover for a bottle containing sparkling liquid. The remover includes an outer body and an inner body having a cork-gripping device and being slidably mounted in the outer body. The cork remover includes a notch for positioning the outer body over a bottle cork's safety harness. The bottle-gripping device is on the outer body for engaging on the bottle neck and structure for restricting the inner body's sliding movement in the cork's expelling direction.

4 Claims, 4 Drawing Sheets

CORK REMOVER FOR A BOTTLE CONTAINING SPARKLING LIQUID

This Application is the U.S. National Phase of International Application Number PCT/EP2012/060798 filed on Jun. 7, 2012, which claims priority to European Patent Application No. 11168885.9 filed on Jun. 7, 2011.

FIELD OF THE INVENTION

The present invention relates to a cork remover for a bottle containing sparkling liquid.

BACKGROUND OF THE INVENTION

It is commonly known that bottles containing sparkling liquid and closed by a cork, e.g. champagne bottles, are under high pressures up to almost 7 bars. Consequently, accidents happen on a regularly base by corks becoming uncontrollable projectiles upon opening the bottle. Such expelled cork can be very dangerous and harmful for the consumer's face and in particular the eyes.

In the state of the art, several attempts are made to avoid such dangerous situations. For example, WO2006092661 (Mauffette) describes a cork remover where relative rotation causes cork-gripping means to exert an upward action on the cork. The cork is thus lifted upwardly until it is finally expelled from the bottle under the action of the pressure inside the bottle and wherein the expelled cork is trapped in a space provided in the cork remover decreasing in cross sectional area in the direction of cork expelling direction.

Another example is WO2008061547 (Ferrari) describing a cork remover with an outer body engaging on the bottle neck bulge and an inner body engaging on the cork. The inner body is slidably mounted in the outer body such that it slides upwardly when the cork is expelled.

However, besides the fact that the last cited cork remover is quit complex in manufacturing and in use, a remaining problem of all above cork removers is that, although the cork is trapped by the cork remover, the safety harness still has to be removed from the bottle neck bulge before positioning the cork remover. As a consequence, the risk remains that the cork will be accidentally expelled before placing the cork remover.

In an attempt to solve the above problem, U.S. Pat. No. 4,750,391 describes a cork remover having a frame with pivotable annulus for placing the cork remover over the cork and the safety harness, and a pair of thongs connected to a pair of arms for lifting the cork.

A disadvantage of this type of cork remover is its complexity in manufacturing the parts and in assembling.

Another disadvantage is that a user needs two hands for engaging the handles such that he is compelled to provide a stable, horizontal, un-slippery surface for placing the bottle on.

A second remaining problem is that state of the art cork removers are not adapted to withstand the lifting pressure on the cork in the last phase of the opening process. As a result, the consumer cannot avoid that the cork is expelled abruptly in the last phase of the opening process. As is commonly known, the quality of for example champagne is decreased by brutal cork expel because then the pressure in the bottle drops abruptly and the carbon dioxide concentration in the liquid decreases to much.

Considering the above drawbacks, it is a first object of the present invention to provide a cork remover adapted to trap the expelled cork.

It is a second object of the present invention to provide a cork remover for which it is not required to remove the safety harness from the bottle neck bulge before positioning the cork remover.

Further, it is a third object of the present invention to provide a cork remover having the ability to controllably release the cork, even in the last phase of the opening process, such that the genuine quality of the sparkling liquid can be kept.

Another object of the present invention is to provide a cork remover which is less complex in manufacturing and less complicated in use.

The present invention meets the above objects by providing a cork remover comprising an outer body, and an inner body having cork-gripping means and being slidably mounted in the outer body, characterized in that the outer body comprises a notch for positioning the outer body over a bottle cork's safety harness and releasing the safety harness's eye.

SUMMARY OF THE INVENTION

The present invention is directed to a cork remover for a bottle containing sparkling liquid comprising:

an outer body, and an inner body having cork-gripping means and being slidably mounted in the outer body, characterized in that the cork remover comprises a notch for positioning the outer body over a bottle cork's safety harness, bottle-gripping means on the outer body for engaging on the bottle neck and means for restricting the inner body's sliding movement in the cork's expelling direction

DESCRIPTION OF THE INVENTION

Figure 1:
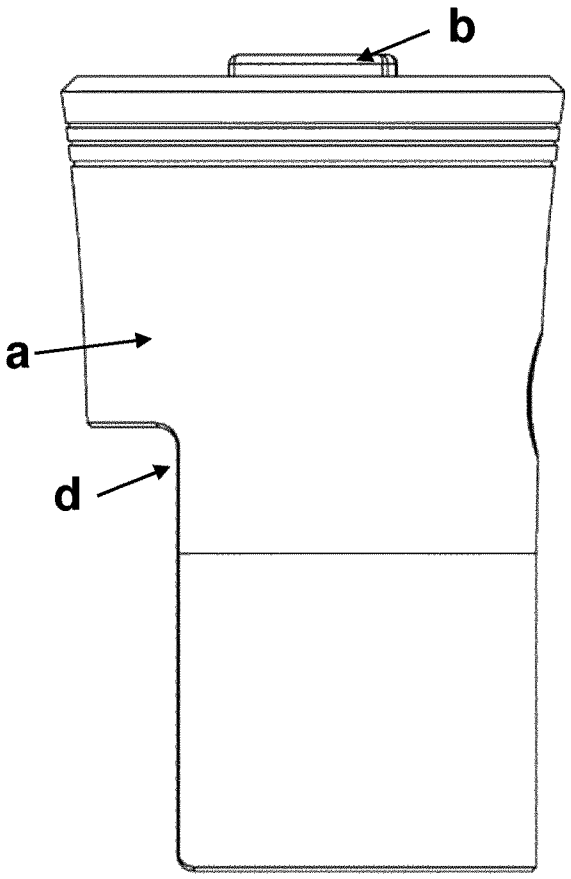
FIG. 1 illustrates an embodiment of a cork remover in accordance with the present invention.

According to a first embodiment of the present invention and as illustrated in FIG. 1, a cork remover for a bottle containing sparkling liquid is provided comprising:

an outer body (a), and an inner body (b) having cork-gripping means ((c) not shown) and being slidably mounted in the outer body, characterized in that the outer body comprises a notch (d) for positioning the outer body over a bottle cork's safety harness and releasing the safety harness's eye.

A first advantage of such cork remover is that the cork, while being lifted and at the end of the opening process completely released, is held by the cork-gripping means of the equally lifting inner body.

A second advantage is that, by providing the notch in the outer body, it is not required to remove the safety harness from the bottle neck bulge before positioning the cork remover, thereby avoiding accidental cork expel, dangerous situations and accidents.

In accordance with the present invention, the cork remover may comprise an outer body having bottle-gripping means, and expel prevention means for preventing the cork from being entirely expelled.

The advantage of providing the expel prevention means for preventing the cork from being entirely expelled is that the cork remover is able to resist the high lifting pressure on the cork in the last phase of the bottle opening process, and that the user has the ability to controllably release the cork, even in that last phase of the opening process, such that the genuine quality of the sparkling liquid can be kept.

In an embodiment of the present invention, the expel prevention means may comprise bottle-gripping means for engaging on the bottle neck and means for restricting the inner body's sliding movement in the cork's expelling direction.

Such restricting means may be any means adapted for blocking the lifting movement of the inner body relative to the on the bottle neck engaging bottle-gripping means in the last phase of the opening process, such that the cork is indeed lifted, but not abruptly expelled and entirely released. Subsequently the user may controllably release the cork entirely by cautiously removing the cork remover holding the cork.

Figure 2:
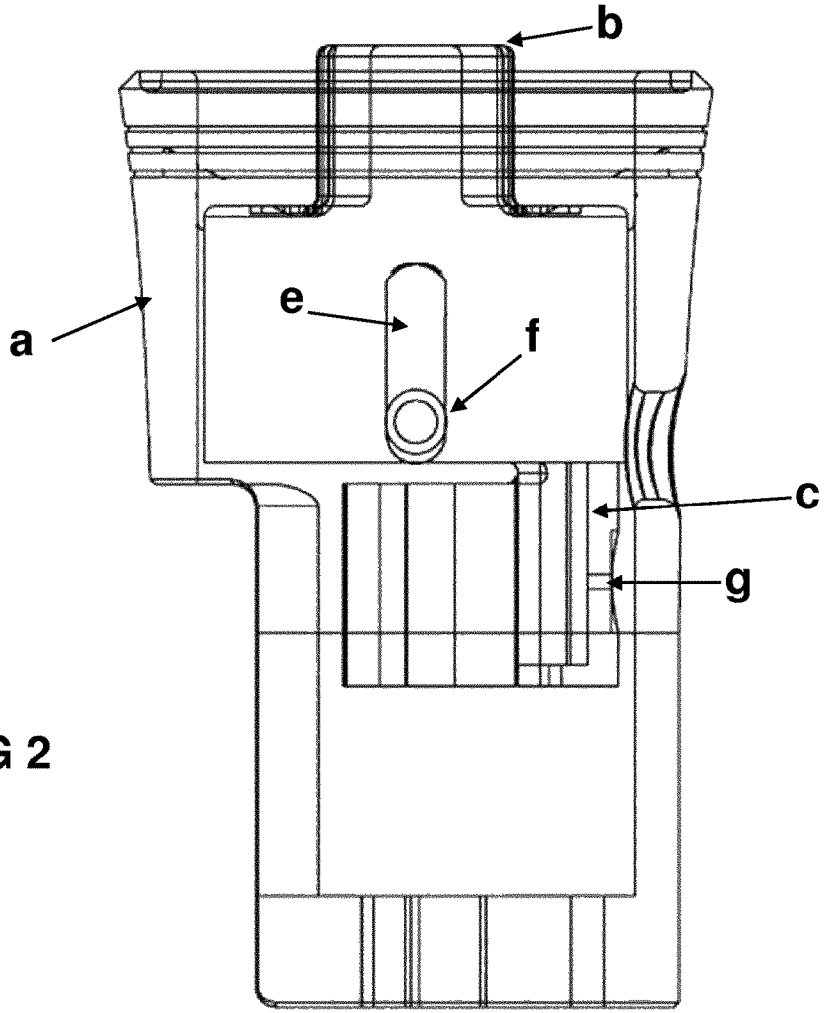
FIG. 2 illustrates another embodiment of a cork remover in accordance with the present invention.

In a particular embodiment in accordance with the present invention and as illustrated in FIG. 2, the means for restricting the inner body's sliding movement may comprise a protrusion (f) on the inner body's outer side, said protrusion sliding in a slit (e) that is provided in the outer body and extends at least partially in the cork's expelling direction, said slit having a form and size adapted to prevent the cork from being entirely expelled.

A person skilled in the art will understood that the slit and protrusion may have any adapted form and size such that the movement of the protrusion and consequently the inner body is blocked in the cork's expelling direction in so far that preferably a minor part of the cork is not expelled.

At least part of said slit may extend straightly in the cork's expelling direction. In this case the inner body will move upwardly and turn equally when turning the outer body (or the bottle) upon opening the bottle.

Alternatively, at least a part of the slit may extend helically in the cork's expelling direction. In this case the inner body will move upwardly, but will not turn when turning the outer body (or the bottle) upon opening the bottle.

In another particular embodiment, the inner body may be extended through the top of the outer body (see FIG. 1 (*b*)) such that a user is able to resist the high lifting pressure on the cork and on the inner body by pressing on the top of the inner body against the lifting pressure (i.e. the user may hold the cork remover in one hand and pushing with his thumb on the top of the inner body). Subsequently the user may controllably release the cork entirely by cautiously releasing downward pressure on the inner body.

In an embodiment, optionally in combination with the foregoing embodiment, the inner body's upwardly sliding movement may be blocked by collision with the outer body such that the cork is prevented from being entirely expelled.

Figure 3:
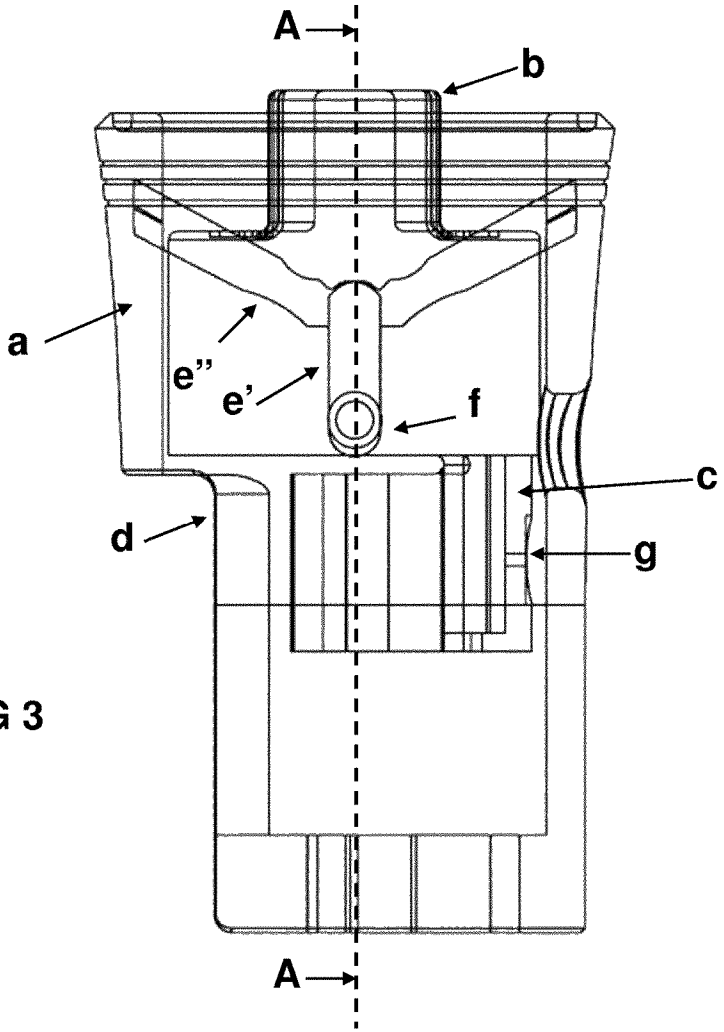
FIG. 3 illustrates a preferred embodiment of a cork remover in accordance with the present invention.
Figure 4:
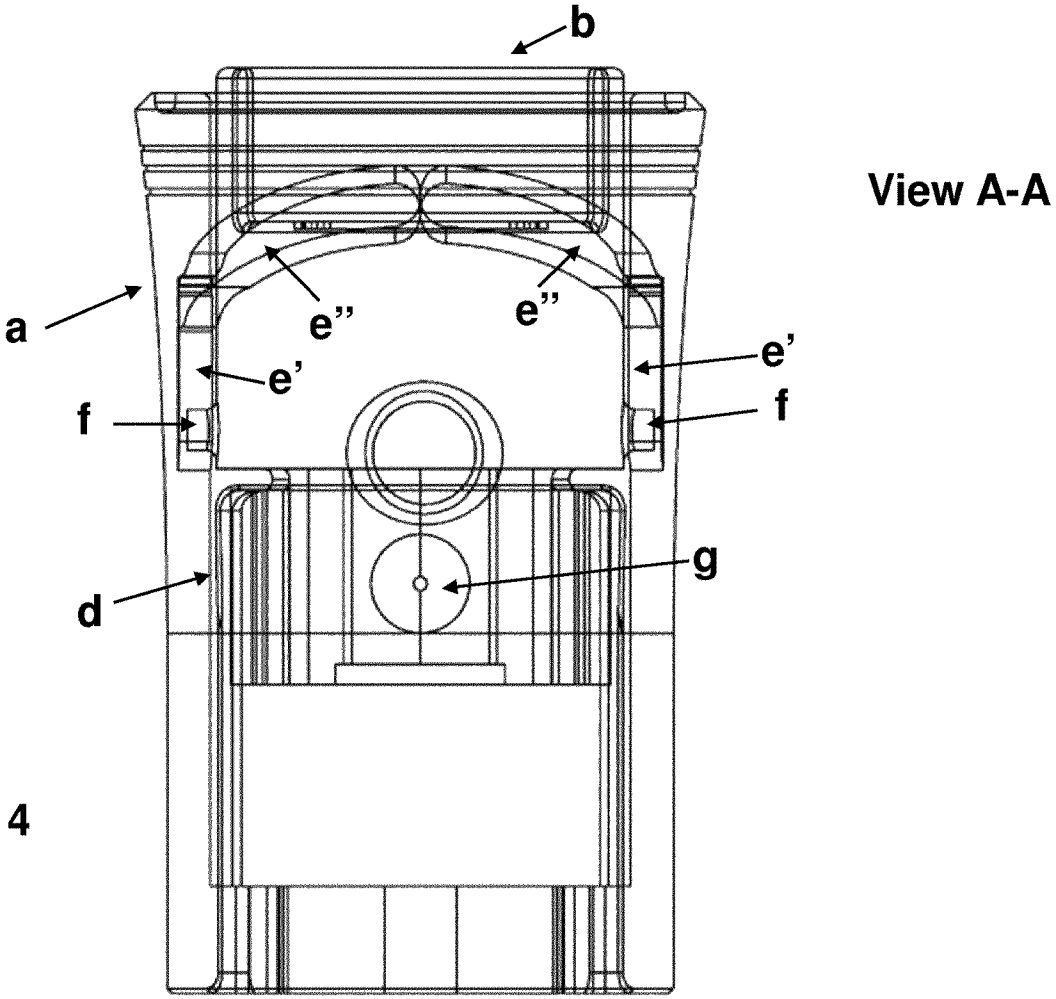
FIG. 4 illustrates a cross section of said preferred embodiment.

In a preferred embodiment in accordance with the present invention and as illustrated in FIG. 3 and FIG. 4, a cork remover may be provided wherein a first part (e') of the slit extends straightly in the cork's expelling direction, said first part's length being sufficiently short to prevent the cork from being entirely expelled, and wherein a second part (e") of the slit further extends helically in the cork's expelling direction for controllably releasing the cork. Upon turning the outer body, the protrusion will slide upwardly in the slit and be blocked at the slit's end. Upon then turning the inner body, the protrusion will slide in the helical part of the slit such it is moved further upwardly.

An advantage of such embodiment is that the consumer may open a bottle closed by a cork and safety harness in a safe and uncomplicated way, following the following sequence:

- placing the outer body (a) sideways on the bottle neck, positioning the notch (c) over the safety harness's eye
- sufficiently releasing the safety harness's eye
- holding the bottle and turning the outer body (a) left or right (or holding the cork remover and turning the bottle), such that the cork-gripping means and the pressure in the bottle exert a lifting action on the cork. The inner body (b) will lift equally and will be blocked by the protrusion (f) at the upper end of the straight part (e') of the slit, such that the cork is not expelled entirely.
- turning the inner body (b) such that the protrusion slides in the helical part (e") of the slit. Thereby the inner body is further lifted in a controlled way and the cork is finally entirely released.

The inner body may have a plurality of protrusions on its outer side, sliding in a plurality of slits provided in the outer body.

In a particular embodiment the cork-gripping means of the inner body may comprise a pin (g) or a plurality of pins for intruding into the cork. The advantage of a pin is that it can easily intrude in the cork without being hindered by the safety harness.

A person skilled in the art will understood that alternative embodiments in accordance with the present invention are possible wherein the expel prevention means are likewise based on a slit-protrusion system.

For example, protrusion(s) may be provided at the inner side of the outer body (instead of at the outer side of the inner body) and a slit may be provided in the inner body (instead of at the inner side of the outer body), such that upon the inner body being lifted, the slit slides over the protrusion(s). Such slit in the inner body may be at least partly straight in the cork expel direction, or at least partly helical in the cork expel direction, or a combination of both.

In another example, the inner body as a whole may slide in a slit formed by an adapted inner perimeter of the outer body. The inner body may have a non-cylindrical outer perimeter fitting and sliding into a corresponding non-cylindrical inner perimeter of the outer body.

The invention claimed is:

1. A cork remover for a bottle containing sparkling liquid comprising:

- an outer body, and
- an inner body having cork-gripping device, the inner body encased within the outer body with only a top surface of the inner body protruding through a top surface of the outer body, the inner body slidably mounted within the outer body,
- a notch for positioning the outer body over a bottle cork's safety harness,
- a bottle-gripping device on the outer body for engaging on the bottle neck, and
- a structure for restricting the inner body's sliding movement in the cork's expelling direction comprising a protrusion on the inner body's outer side or on the outer body's inner side, said protrusion sliding in a slit that is provided respectively in the outer body or in the inner body and extending at least partially in the cork's expelling direction,
- wherein the slit includes at least a first part, the first part of the slit extends straightly in the cork's expelling direction, said first part's length being sufficiently short to prevent the cork from being entirely expelled, wherein upon turning either the inner or the outer body the protrusion will slide upwardly in the first part of the slit and be blocked at a first part's end, wherein the cork gripping device is a pin that intrudes into the cork.

2. The cork remover according to claim 1, wherein the slit includes a second part extending helically in the cork's expelling direction for controllably releasing the cork wherein upon turning the other of the inner and outer body the protrusion slides in the second part of the slit such that it is moved further upwardly.

3. The cork remover according to claim 2, wherein the inner body has a plurality of protrusions on its outer side, sliding in a plurality of slits provided in the outer body.

4. The cork remover according to claim 1, wherein the inner body has a plurality of protrusions on its outer side, sliding in a plurality of slits provided in the outer body.

* * * * *